US006605161B2

(12) United States Patent
Fairbourn

(10) Patent No.: US 6,605,161 B2
(45) Date of Patent: Aug. 12, 2003

(54) INOCULANTS FOR INTERMETALLIC LAYER

(75) Inventor: David C. Fairbourn, Sandy, UT (US)

(73) Assignee: Aeromet Technologies, Inc., Sandy, UT (US)

( * ) Notice: Subject to any disclaimer, the term of this patent is extended or adjusted under 35 U.S.C. 154(b) by 12 days.

(21) Appl. No.: 09/874,855

(22) Filed: Jun. 5, 2001

(65) Prior Publication Data

US 2002/0179191 A1 Dec. 5, 2002

(51) Int. Cl.[7] ..... C23C 22/00

(52) U.S. Cl. ..... 148/243; 148/273; 148/275; 148/279; 148/283; 427/252; 427/304; 427/333; 427/405; 427/419.1

(58) Field of Search ..... 148/243, 273, 148/275, 279, 283; 427/252, 304, 333, 405, 419.1

(56) References Cited

U.S. PATENT DOCUMENTS

| | | | | |
|---|---|---|---|---|
| 4,066,817 A | | 1/1978 | De Rossi | |
| 4,314,559 A | | 2/1982 | Allen | |
| 4,333,467 A | | 6/1982 | Domicone | |
| 4,677,147 A | | 6/1987 | Swihart et al. | |
| 5,585,186 A | | 12/1996 | Scholz et al. | |
| 5,650,235 A | * | 7/1997 | McMordie et al. | 428/610 |
| 5,736,251 A | | 4/1998 | Pinchuk | |
| 5,750,197 A | | 5/1998 | van Ooij et al. | |
| 6,054,522 A | | 4/2000 | Carre et al. | |
| 6,110,262 A | * | 8/2000 | Kircher et al. | 106/14.21 |

FOREIGN PATENT DOCUMENTS

| | | |
|---|---|---|
| EP | 0 491 414 | 6/1992 |
| EP | 0651005 B1 | 10/1994 |
| EP | 0 821 078 | 1/1998 |
| EP | 1 013 787 | 6/2000 |
| WO | WO 00/38844 | 7/2000 |

OTHER PUBLICATIONS

Das, D.K. et al., *The Cyclic Oxidation Performance of Aluminide and Pt–Aluminide Coatings on Cast Ni–Based Superalloy CM–247*, JOM–e, 52 (1)(2000), The Minerals, Metals and Materials Society, website printout (9 pages) (no month data).

International Search Report (3 pages).

* cited by examiner

*Primary Examiner*—John Sheehan
*Assistant Examiner*—Andrew L. Oltmans
(74) *Attorney, Agent, or Firm*—Wood, Herron & Evans, LLP

(57) ABSTRACT

A deposition process including applying an inoculant to at least a portion of the surface of a metal component, and then forming an intermetallic layer at the inoculant surface, such as by exposing at least the coated surface portion to a deposition environment.

41 Claims, 5 Drawing Sheets

INOCULANTS FOR INTERMETALLIC LAYER

BACKGROUND OF THE INVENTION

1. Field of the Invention

The present invention relates to formation of an intermetallic layer on a metal component and, more particularly, to formation of an intermetallic layer on the airflow surface of a jet engine metal component.

2. Description of Prior Art

The surface of metal components is often desirably treated to form an intermetallic layer thereat by which to protect the underlying metal component and thereby prolong its useful life. By way of example, in the aerospace industry, many of the components in a jet engine or other aspect of a plane are provided with an aluminide layer to protect the airflow surfaces from corrosion. Over time, the aluminide layer will wear and need to be repaired. In those cases, any oxide layer and remaining aluminide or other intermetallic layer on the component is removed such as by stripping in acid and/or gritblasting to reveal an underlying surface of the metal component. The metal component, such as a nickel-based or cobalt-based superalloy jet engine component, is then placed in a simple CVD furnace, for example, and exposed to a deposition environment such as near vacuum and high heat with appropriate activators and donor materials from which to form the intermetallic layer. Where the intermetallic layer is to be an aluminide, the donor material may be aluminum in the form of chromium-aluminum or cobalt-aluminum chunklets, for example. In the deposition environment, the aluminum frees from the chunklets and forms a nickel-aluminide layer on the nickel-based superalloy component (which layer may be referred to simply as an aluminide layer, for shorthand). The aluminide layer includes an additive portion growing outwardly of the original metal surface of the component and which has a high concentration of aluminum. The aluminide layer may also include a diffusion portion extending partially into the component inwardly of the level of the original surface and which will have a high concentration of the component metal, such as nickel. This same process may be used for new components after removal of the natural oxide layer which might form on the component when it is first manufactured.

The intermetallic layer is to be formed or grown to a desired overall thickness by exposing the component, and especially its surface, to the deposition environment for a predetermined time sufficient to form the layer. The length of time necessary to run the simple CVD furnace through a complete cycle necessarily limits the number of parts that can be processed through that furnace in a given period of time, such as a workshift. Shortening the cycle time would be advantageous in that more parts could be processed over a workshift, for example, thereby reducing costs on a per part basis. Unfortunately, while the process variables may be adjusted in ways which might slightly affect the time required to form the desired thickness of the intermetallic layer, efforts to substantially reduce the time typically require undesired process variable changes. Those process variable changes can prove undesirable from a cost or safety standpoint and/or from a product standpoint. Thus, there remains a need to reduce cycle time but without undesirable changes to the process variables involved in the deposition environment.

In addition to the above, there are some situations where it is desirable to form a multi-component intermetallic layer, i.e., an intermetallic layer that includes a functional material other than just from the donor (e.g., aluminum) or the component (e.g., nickel). In the aerospace industry, for example, it has long been desired to include silicon, chromium or platinum in the aluminide layer, so as to enhance the performance characteristics of the intermetallic coating layer. Current efforts to include silicon are largely unacceptable. And while addition of chromium or platinum has been accomplished, the process involved in the addition of those materials has been complex and costly. By way of example, platinum may be added by first electroplating the clean metal surface with platinum prior to exposing the part to the deposition environment for the formation of the aluminide layer. It is thought that during the deposition of the aluminide layer, the platinum atoms free from the plating and migrate into the aluminide layer thereby providing a desirably strong and durable platinum aluminide deposition layer. While the addition of the platinum provides a desirably improved metal component in terms of its durability and useful life, electroplating a product with platinum is an expensive and difficult procedure. Hence, there remains the need to easily and inexpensively add an additional functional material to the intermetallic layer to form a multi-component layer.

SUMMARY OF INVENTION

The present invention provides an improved deposition process by which to form an intermetallic layer on a metal component which overcomes some of the above-noted drawbacks. To this end, and in accordance with the principles of the present invention, an inoculant is first applied to the surface of the metal component at which the intermetallic layer is to be formed. The inoculant may be applied to the entire surface or may be applied selectively to one or more surface portions of the metal component. The inoculant is advantageously applied in a liquid state and then dried to form a pre-coat of the inoculant. The pre-coated component is then placed into the deposition environment where the intermetallic layer is formed. It is found that the intermetallic layer grows or forms more quickly at the pre-coated surface, than would have occurred without the inoculant. Thus, a thicker intermetallic layer forms in an area of the component that was pre-coated with the inoculant as compared to an area that was not pre-coated. As a result, the desired thickness of the intermetallic layer may be formed in a reduced period of time as compared to a conventional deposition process. That result may be used to advantageously reduce the cycle time of the simple CVD furnace which provides the desired benefits in cost savings and the like. Alternatively, a thicker intermetallic layer may advantageously be formed where the cycle time is not substantially reduced with a pre-coated component as compared to a component that was not pre-coated. It will thus be appreciated that as used herein, the term inoculant refers to a material that when applied to a metal surface which is then exposed to a deposition environment, will cause an intermetallic layer to form at the surface more quickly or to a greater thickness than would occur without the inoculant. Advantageously, the inoculant may be a silane material or a metal-halogen Lewis acid material, by way of example, In addition to the foregoing, it is possible to form two different thicknesses of intermetallic layer on the same component, depending upon which portion thereof is pre-coated with the inoculant. By selectively coating the component, a desirably thick intermetallic layer may be formed on the areas of the component which need the most protection, while providing a thinner layer on areas less susceptible to damage such as from corrosion. In a particular application, the inoculant may be applied to the air flow surface(s) of a jet engine component (such as a blade) to subsequently form a desirably thick aluminide coating in these areas. Other portions of the blade, such as those which might abut other components in the engine are not pre-coated and so will result in a thinner intermetallic layer in those areas.

In accordance with a further aspect of the present invention, applying a liquid inoculant coating may be done simply by dipping the part or by spraying or brushing the liquid inoculant onto the part, either completely or selectively, which thus allows for application of coating not only to the exposed, readily viewable surfaces, but also to the internal surfaces, such as a hollow interior of a cooling hole or passage in a jet engine blade. As a consequence, the inoculant can be provided on internal surfaces otherwise not readily plated to thereby enhance the growth of the intermetallic layer thereat to thus protect those surfaces and prolong the useful life of the metal component.

In accordance with a yet further aspect of the present invention, the inoculant may be used to easily and inexpensively add additional functional material to the intermetallic layer to thus provide the sought-after multi-component layer. Thus, where the inoculant is a silane material, silicon is advantageously diffused into the intermetallic layer during formation in the deposition environment. Similarly, where the innoculant is a metal-halogen Lewis acid, the metal ion of the Lewis acid may be selected for its beneficial properties in connection with the intermetallic layer. Thus, for example, the Lewis acid may be $CrCl_3$, $PtCl_4$, $ZrCl_4$, or $ZrF_4$ to thus include the metal ions of either chromium, platinum, and/or zirconium as the additional functional material in the intermetallic layer. When the part with such a Lewis acid inoculant thereon is exposed to the deposition environment, it is believed that the halogen (i.e., the chlorine or flourine) becomes part of the reactant gas, and the chromium, platinum and/or zirconium ions, for example, will free from the inoculant and migrate into the intermetallic layer, such as an aluminide layer, being formed on the metal component to thereby produce a desired chromium aluminide, platinum aluminide, and/or zirconium aluminide layer with its advantageous properties. However, the Lewis acid inoculant is applied more easily and thus less expensively than a platinum or chromium plating, and is also a much lower cost material than is platinum or chromium used for plating.

Where the inoculant is a Lewis acid of the metal-halogen type, there may be some metal components which will experience grain boundary problems at the surface in the deposition environment. In accordance with a further aspect of the present invention, the advantage of the Lewis acid inoculant may be obtained without such grain boundary problems by application of a fine powder of the desired donor metal to the Lewis acid on the component while still in the liquid state. By way of example, aluminum powder may be sprayed onto the liquid Lewis acid on the surface. When the component with the Lewis acid inoculant and added donor metal is in the deposition environment, the grain boundary problem is reduced or minimized.

In accordance with a still further aspect of the present invention, the inoculator may be selectively applied to aerospace components and particularly jet engine components such as blades, shrouds, and vanes to name a few. Such components have portions exposed to the high-pressure air flow path of the engine where an intermetallic layer, and a possibly multi-component intermetallic layer, is desired. At the same time, other portions of those aerospace components are not in the air flow path and so do not need the same level of protection in use. In some situations, the growth of more than a thin intermetallic layer can be detrimental, particularly with respect to those portions of the component that contact other engine components and must thus fit together in close tolerances. In such situations, the inoculant may be selectively applied to those portions of the component adapted to be exposed to the high-pressure air flow, so as to permit growth of the desirable thick and/or multi-component intermetallic layer on those portions. The remaining portions of the component may either be shielded as conventional, or permitted to grow an intermetallic layer which will, however, be thinner than that formed in the pre-coated areas due to the lack of the pre-coating of inoculant thereon.

By virtue of the foregoing, there is thus provided an improved deposition process by which to form an intermetallic layer on metal components. These and other objects and advantages of the present invention shall become apparent from the accompanying drawings, and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1A:
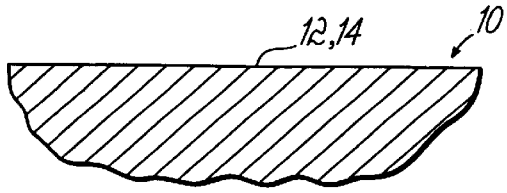
FIG. 1A is a partial, cross-sectional, schematic view of a representative metal component.

With reference to FIG. 1A there is shown in cross-section a representative section of a metal component 10. Component 10 is comprised of a metal or alloys of metal, as is conventional, and has a surface 12 to be protected such as from corrosion and/or high temperature oxidation. Surface 12 may be visible to the naked eye or may be hidden below other structures or parts of the component. Hence, it will be appreciated that the component 10 of FIG. 1A is merely exemplary of any metal component having one or more surfaces 12 to be protected.

Figure 1B:
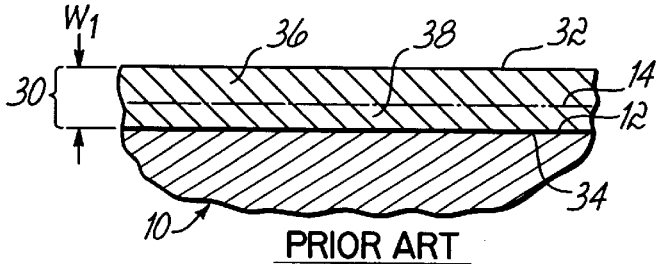
PRIOR ART FIG. 1B
FIG. 1B shows the component of FIG. 1A with an intermetallic layer formed thereon after a time $T_1$ in a deposition environment in accordance with a prior art process.

To protect surface 12, the following have been conventional. First, one or more components 10 are cleaned to remove any oxide or other undesired material (not shown) from surface 12 of each component so as to expose the bare metal thereof at the level 14 of surface 12 (level 14 may define a plane if surface 12 is planar). Component(s) 10 is then placed into the chamber 20 of a simple CVD furnace 22 as shown schematically in FIG. 4. The CVD furnace 22 produces partial pressures and high heat within chamber 20. Also included within chamber 20 may be an activator 21 such as ammonium biflouride and a donor metal 24 as well as positive pressure of argon (not shown). Where component 10 is comprised of a nickel-based superalloy, donor metal 24 may be aluminum which can be provided in the form of chromium-aluminum, cobalt-aluminum or vanadium-aluminum chunklets or powders, for example. The resulting partial pressures and high heat create a deposition environment 26 which releases aluminum from the chunklets 24 to create a vapor having aluminum therein (as indicated by arrows 28) to thus expose surface 12 to the aluminum donor metal. That exposure results in an intermetallic layer 30 in the form of aluminide to form at surface 12 of component 10 which layer 30 then serves to protect surface 12 (FIG. 1B).

Depending on the time ($T_1$), during which component 10 is exposed to the deposition environment, the intermetallic layer 30 will typically form to a specific depth $W_1$ measured between its top or outermost extent 32 and its bottom or innermost extent 34. Layer 30 will typically include at least an additive portion 36 extending outwardly from or above the level 14 of original surface 12 to outermost extent 32. Intermetallic layer 30 may also include a diffusion portion 38 extending inwardly from level 14 and into component 10 to innermost extent 34 which is usually below level 14 but could be coextensive therewith if no diffusion portion 38 is formed. Thus, most of layer 30, if not all, is in the additive portion 36, but that is not required or essential, and the dynamics of the material and process conditions involved will dictate the extent of the respective portions of layer 30. Additive portion 36 will typically include a high concentration of the donor metal 24 such as aluminum, and may include some of the metal from component 10, such as nickel if component 10 is comprised of a nickel-based superalloy, for example, due to outward diffusion of the metal from component 10. By contrast, diffusion portion 38 will have a lower concentration of the donor metal 24 and a high concentration of the metal of component 10.

Figure 2A:
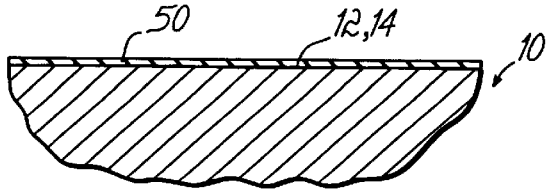
FIG. 2A shows the component of FIG. 1A with an inoculant applied to the surface thereof in accordance with the principles of the present invention.
Figure 4:
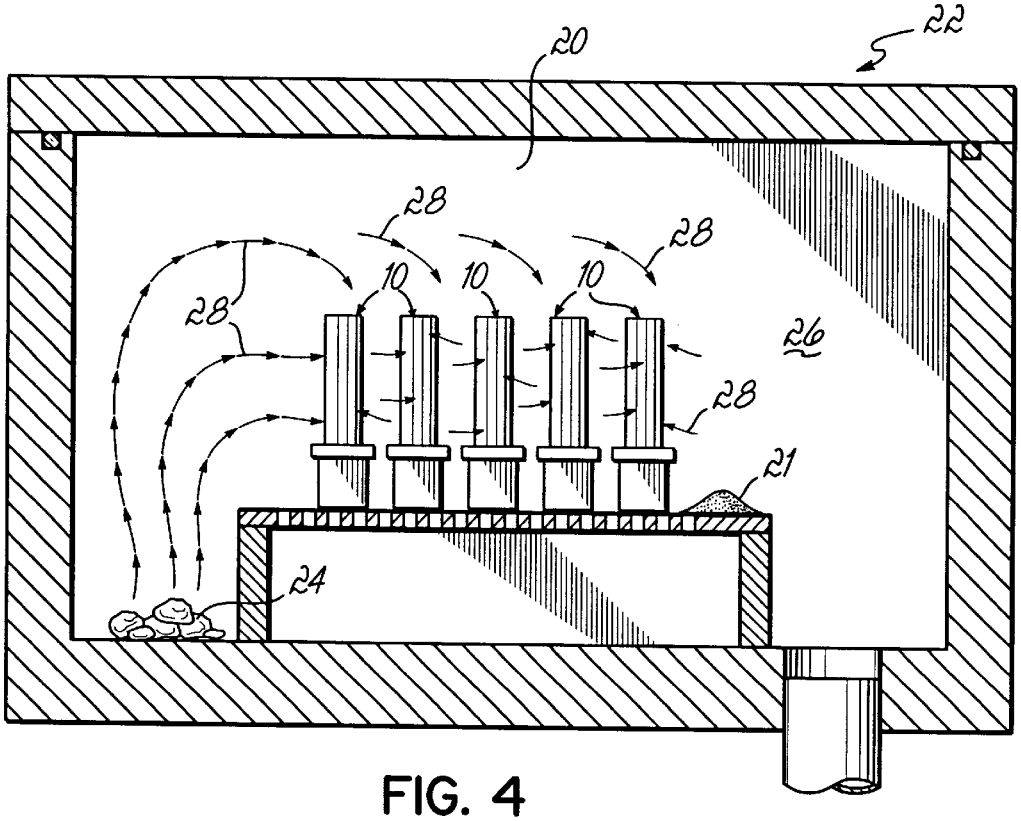
FIG. 4 is a schematic view showing components, such as that from FIG. 1A, FIG. 2A, and/or FIG. 3A, in a deposition environment of a simple CVD furnace for purposes of explaining the principles of the present invention.

It is desired to form an intermetallic layer to be either substantially thicker than $W_1$, for the same time ($T_1$) of exposure to the deposition environment 26, or to be substantially the same thickness $W_1$ but for substantially less time ($T_2<T_1$) of exposure to the deposition environment 26, all without substantial variation in the other process variables applied to the deposition environment 26. To these ends, and in accordance with the principles of the present invention, such results are found to be possible by first applying a pre-coating of inoculant 50 to surface 12 (FIG. 2A), before component 10 is placed in the deposition environment 26. Inoculant 50 is advantageously applied in readily available liquid form and then dried to form a pre-coating. Thereafter, component 10 pre-coated with inoculant 50 thereon is placed in the deposition environment 26 (FIG. 4).

Figure 2B:
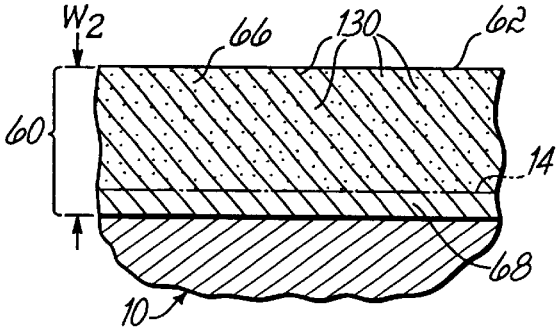
FIGS. 2B and 2C show the component of FIG. 2A with respective intermetallic layers formed thereon after respective times $T_1$ and $T_2$ in a deposition environment in accordance with a process of the present invention.

With reference to FIG. 2B, after component 10 is in deposition environment 26 for the previously predetermined time $T_1$ and under substantially the same process variables, an intermetallic layer 60 will form at surface 12, but to a thickness $W_2$, which is anywhere from 20% to 80%, and typically about 40%, greater than thickness $W_1$. Layer 60 includes an additive portion 66 which extends to outermost extent 62 which is farther from level 14 than was outermost extent 32 of additive portion 36 (FIG. 1B). The diffusion portion 68 may also extend into component 10 by more, less, none or the same amount as did portion 38 depending upon the inoculant 50, for example. The result, however, is that a thicker intermetallic layer 60 ($W_2>W_1$) is grown by exposure to the deposition environment 26 for substantially the same time span $T_1$ by virtue of the inoculant pre-coating 50, than was possible without the pre-coating.

Alternatively, where it is desired to grow an intermetallic layer 70 (FIG. 2C) which has a thickness $W_3$ which is substantially equal to thickness $W_1$ of layer 30, in accordance with the principles of the present invention, cycle time of the simple CVD furnace 22 may be substantially reduced to a time $T_2$, which is substantially less than the time $T_1$ necessary to form layer 30 as above described (by at least about 20%), without otherwise substantially changing the applicable process variables. To this end, component 10 with inoculant 50 pre-coated thereon is placed in the deposition environment 26 (FIG. 4) and exposed to the deposition environment for the time $T_2$ ($<T_1$). After removal from the CVD furnace 22, it will be found that the intermetallic layer 70 formed at surface 12 is substantially similar ($W_3 \approx W_1$) in thickness to layer 30. However, additive portion 76 of layer 70 may actually be thicker than additive portion 36 of layer 30 whereas diffusion portion 78 of layer 70 may be thinner than diffusion portion 38 of layer 30 due to the dynamics of the deposition process and the time in which the component 10 was in the deposition environment 26.

Figure 3A:
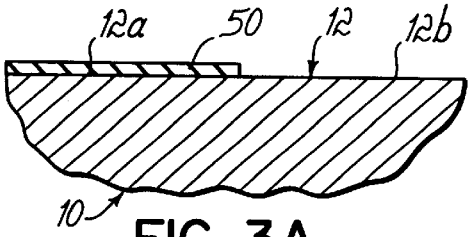
FIG. 3A shows the component of FIG. 1A with an inoculant selectively applied to the surface thereof.
Figure 3B:
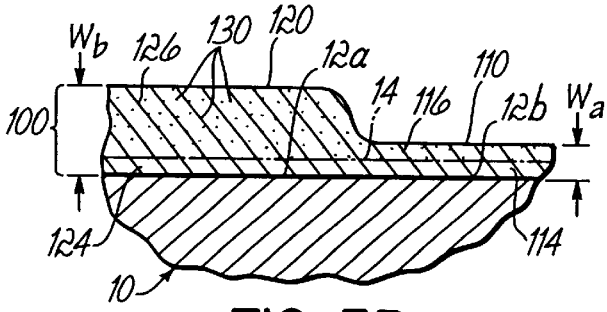
FIG. 3B shows the component of FIG. 3A with a variable thickness intermetallic layer formed thereon after a time in a deposition environment in accordance with a process of the present invention.

In accordance with a further aspect of the present invention, and with reference to FIG. 3A, it may be seen that component 10 may be selectively provided with inoculant 50 such as by pre-coating same over only a selected portion 12*a* of surface 12 leaving portion(s) 12*b* without a pre-coating. After inoculant 50 on portion 12*a* is dried, component 10 with the inoculant 50 on portion 12*a* may be placed in deposition environment 26 as described hereinabove (FIG. 4) in order to form an intermetallic coating 100. However, as seen in FIG. 3B, intermetallic coating 100 may have two different segments 110 and 120 of different thickness. Segment 110 overlying the non pre-coated portions 12*b* of surface 12 will have a first, small thickness $W_a$, and segment 120 overlying portion 12*a* of surface 12 (which was pre-coated with inoculant 50) will have a significantly larger or deeper thickness $W_b$ (i.e., $W_b>W_a$), primarily in the additive portion 126 of segment 120 as compared to the additive portion 116 of segment 110. The respective diffusion portions 124 and 114 may be of substantially equal thickness, although in the areas of pre-coated surface 12*a*, the diffusion portion 124 may be thinner or nonexistent depending upon the nature of the pre-coat 50. As a consequence, it is possible to apply thicker intermetallic layers to selected portions of a component while leaving the remaining surface areas to grow relatively thinner intermetallic layers (or no layers if the area is shielded, not shown).

In accordance with a yet further aspect of the present invention, the inoculant 50 may be applied as a liquid and then dried to form coating 50. One liquid form of the inoculant may be a silane material. The silane suitable for use in the present invention may have mono, bis or tri functional trialkoxy silane. The silane may be a bifunctional trialkoxy silyl, preferably trimethoxy or triethoxy silyl groups. Also amino silanes may be used, although thio silanes may not be desired due to the sulfur content therein. Bisfunctional silane compounds are well known and two preferred for use in the present invention are bis (triethoxysilyl) ethane and bis(trimethoxysilyl) methane. In both of these compounds the bridging group between the two silane moieties is an alkyl group.

Additional commercially available silanes include:

1, 2-Bis(tetramethyldisoloxanyl) Ethane 1, 9-Bis(triethoxysilyl) Nonane

Bis(triethoxysilyl) Octane

Bis(trimethoxysilyl Ethane 1,3-Bis(trimethylsiloxy)-1, 3-Dimethyl Disiloxane

Bis(trimethylsiloxy) Ethylsilane

Bis(trimethylsiloxy) Methylsilane

AL-501 from AG Chemetall in Frankfurt Germany

The silane may be applied neat, as an aqueous solution, or as an aqueous/alcohol solvent solution. The solvent solution will contain from about 1–2% by volume to about 30% by volume deionized water with the remainder being a lower alcohol such as methanol, ethanol, propanol or the like. Ethanol and methanol are preferred. The solvent is combined with the silane and generally acetic acids to establish a pH of about 4–6. The concentration of the silane compound is not relevant as long as the silane remains in solution during application. Generally, the solution will have about 1% to about 20% silane (which may be measured either by volume or by weight in this range).

One silane solution 50 may be an organofunctional silane such as BTSE 1,2 bis(triethoxysilyl) ethane or BTSM 1,2 bis(trimethoxysilyl) methane. The silane may be dissolved in a mixture of water and acetic acid at a pH of 4, then in denatured alcohol to establish the silane solution 50. The solution has about 10 ml of distilled, de-ionized, RO water, 190 ml of denatured alcohol (mixture of ethanol and isoproponol, N.O.S.) and glacial acetic acid with approximately 10 ml of the BTSE obtained from Aldridge Chemical. Silane concentration is between about 1% and 10% by volume and advantageously about 5% by volume. This readily forms the more or less hard pre-coating 50 at temperatures readily achieved.

The silane solution 50 is applied liberally and any excess is poured off as it is applied, or it is applied by brush B (FIG. 5) as if being painted. The component 10 with inoculant 50 in the form of a silane solution is allowed to dry and then heated such as with a heat gun (not shown), or even in a conventional oven (not shown) to about 250° F. (121° C.) for about 15 to 25 minutes, to form a hard pre-coating 50. Prior to the heating, the solution may first be allowed to dry thereon such as underneath a lamp (not shown). Heating of the solution to form pre-coating 50 may be accomplished by heating the component 10 with the silane solution thereon. Generally, formed coating 50 will be 0.01 to 2.0 g/cm$^2$ of surface. Multiple such coatings 50 may be applied each being dried and heated before the next coating. In one example, three applications of 10% BTSE are applied by handpainting a grit-blasted surface portion 12*a* of one or more components 10, each with intermediate heating cycles at 250° F. (121° C.) for 15 minutes. The selectively pre-coated components 10 (with the three applications of silane inoculant) are placed in a deposition environment 26 for a cycle consisting of 4½ hours of soak at 1960° F. (1071° C.) using ammonium biflouride as the activator (not shown) and Cr—Al chunklets 24 to form intermetallic layer(s) 100 (of layer 110 and layer 120). Thereafter, the component 10 is removed from deposition environment and washed with Dial soap and hot water to remove any soluble flouride deposits. The result is that the intermetallic layers 120 (FIG. 3B) in area 12*a* are, in many cases, significantly deeper or thicker than intermetallic layer 110 in areas 12*b* of each component 10. For this example, one side is surface 12*a* and the opposite side is surface 12*b*.

Alternatively, the pre-coat 50 may be a colloidal silica, such as LUDOX®-AS of E.I. du Pont de Nemours which is available as a 30% by weight solution of silica in water from Aldrich Chemical as solution number 42,083-2. The solution is poured onto surface 12 of component 10 and dried with a heat gun (not shown) and then placed into deposition environment 26 to form the intermetallic layer 60, 70 or 100.

The silane solution or colloidal silica solution is applied directly to the clean surface of component 10 and then heated to form a hard coating 50. Coated component 10 is then exposed to the deposition environment 26 to form the desired intermetallic layer 60, 70 or 100, by way of example. An advantage of the silane or silicon colloidal inoculants is that the silicon material therein will tend to migrate or disperse into the intermetallic layer 60, 70 or 120 (and possibly into areas of layer 110 adjacent to layer 120 where the part has been selectively pre-coated) to thus provide a multi-component layer having not only donor metal 24 and metal(s) from component 10, but also a functional material, as at 130 in FIG. 2B, 2C and 3B, which in this case would be silicon. Where the component 10 is a nickel-based superalloy and donor metal 24 is aluminum, the intermetallic layer may be a silicon nickel aluminide, thus providing the desired added benefit of silicon in the protective layer. Advantageously, at least a 2.0% by weight level of silicon is desired in the additive layer 36, 66, 122.

Inoculant 50 may alternatively be comprised of a metal-halogen Lewis acid which is in powder or liquid form (and applied neat, not mixed, if a liquid) when applied, then dried and heated in a manner similar to the silane inoculant. Such Lewis acids are characterized in that they have a metallic ion which is advantageously beneficial to the intermetallic layer 60, 70 or 120 and a halogen, examples of which include $CrCl_3$, $FeCl_3$, $PtCl_4$, $ZrCl_4$, $ZrF_4$, $RhCl_3$, $IrCl_3$, $RuCl_3$, $CoCl_4$, and $TiCl_4$. If the Lewis acid is selected to be either a chromium-based or a platinum-based Lewis acid (e.g., $CrCl_3$ or $PtCl_4$), then the metal ion would be either chromium or platinum. In those cases, where the inoculant is a Lewis acid that is pre-coated onto all or part of surface 12, after the Lewis acid is dried, the component 10 with the Lewis acid pre-coat 50 thereon is placed into the deposition environment 26 (FIG. 4). It is believed that the halogen of the Lewis acid becomes part of the reactant gas in the deposition environment 26, and that the metal ions of the Lewis acid will migrate or disperse into and become part of the intermetallic layer 60, 70, 100 or 120 (and perhaps fringe portions of layer 110 adjacent layer 120) again as at 130. The result is, for example, a platinum nickel aluminide or a chromium nickel aluminide depending upon the Lewis acid selected. Similarly, if the Lewis acid is iron or zirconium-based, then 130 would be iron or zirconium, respectively, which will produce an iron nickel aluminide or zirconium nickel aluminide.

To avoid grain boundary problems at surface 12 due to the Lewis acid inoculant 50, a metal powder 135 (FIG. 2D) may be included with the Lewis acid 50. Advantageously, the Lewis acid 50 is first applied as a liquid to surface 12, and then the metal powder 135 is applied thereon as a fine coating before inoculant 50 is dried. The metal powder 135 is desirably a pure form of the donor metal 24. Where the donor metal is aluminum, the powder 135 may be −325 mesh powder sprayed onto inoculant 50 such as with a baby's nose aspirator (not shown) or the like. Presence of the metal powder 135 is believed to avoid grain boundary problems at surface 12 during exposure to the deposition environment 26.

Various aircraft jet engine components may be pre-coated with inoculant 50 (including metal powder 135, if desired) to form desirable intermetallic layer(s) 60, 70, or 100 in accordance with the principles of the present invention as will now be described with reference to FIGS. 5–8. By way of example, a jet engine blade component 10*a* (FIGS. 5 and 6) includes an airfoil segment 140 designed to be in the high-pressure, hot airflow path (as indicated by arrows 142). Airfoil segment 140 includes upper and lower airflow surfaces 144, 146 extending from tip edge 148 and joining at curved foil tip 150 (which includes arcuate portions 144*a* and 146*a* of surfaces 144 and 146, respectively). Airfoil segment 140 and its surfaces 144, 146 are integrally supported on a root 152 used to secure blade component 10*a* to the turbine disk (not shown) of the jet engine (not shown). Surface cooling holes 154 on surfaces 144 and 146 communicate interiorally of segment 140 via cooling channels or passages 156 (FIG. 6) to edge cooling holes 158 formed along edge 148 so as to permit cooling air to pass through the interior of segment 140 while blade 10*a* is in use.

Figure 5:
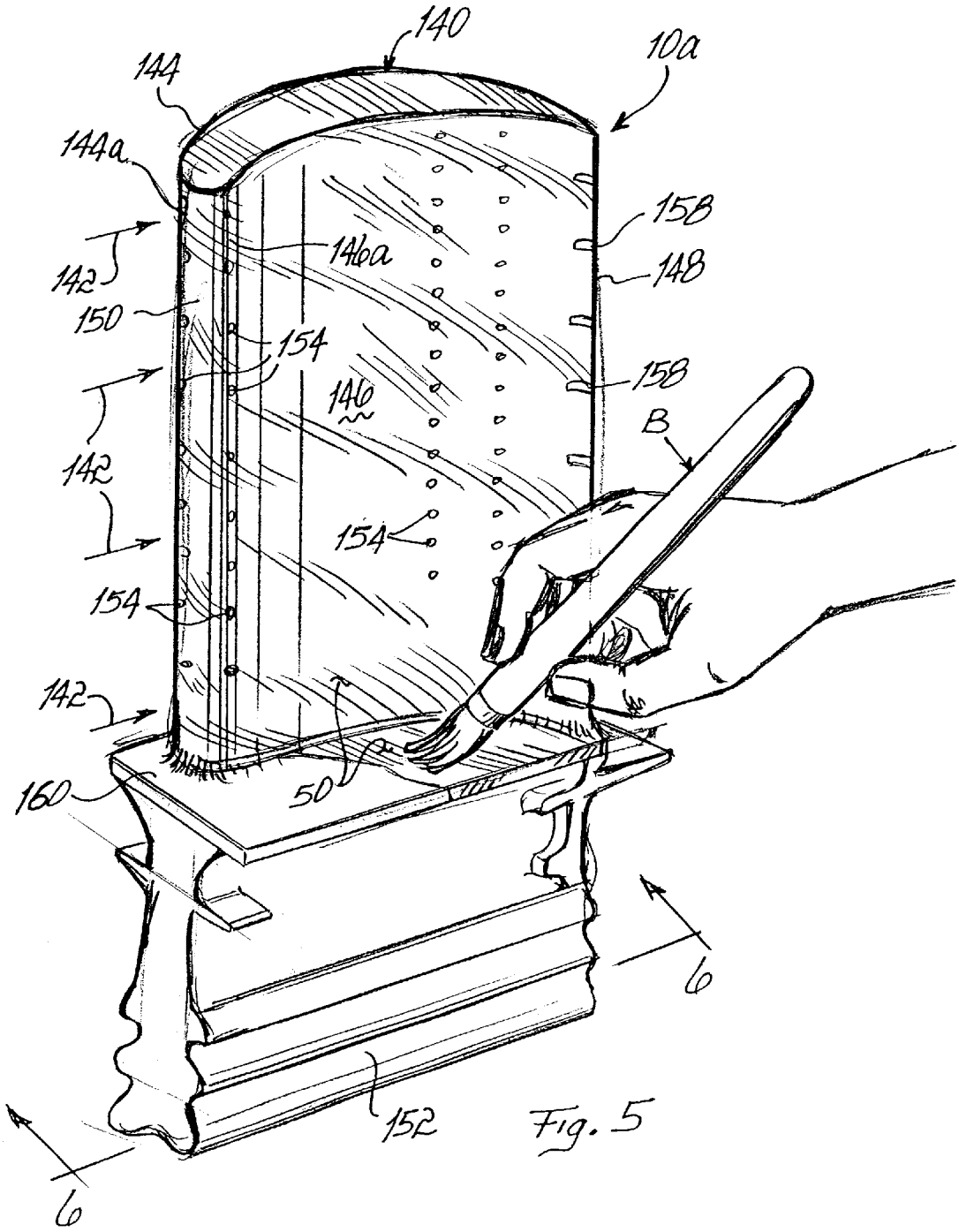
FIG. 5 is a perspective view of a jet engine blade component showing a liquid inoculant being selectively applied thereto in accordance with the principles of the present invention.
Figure 6:
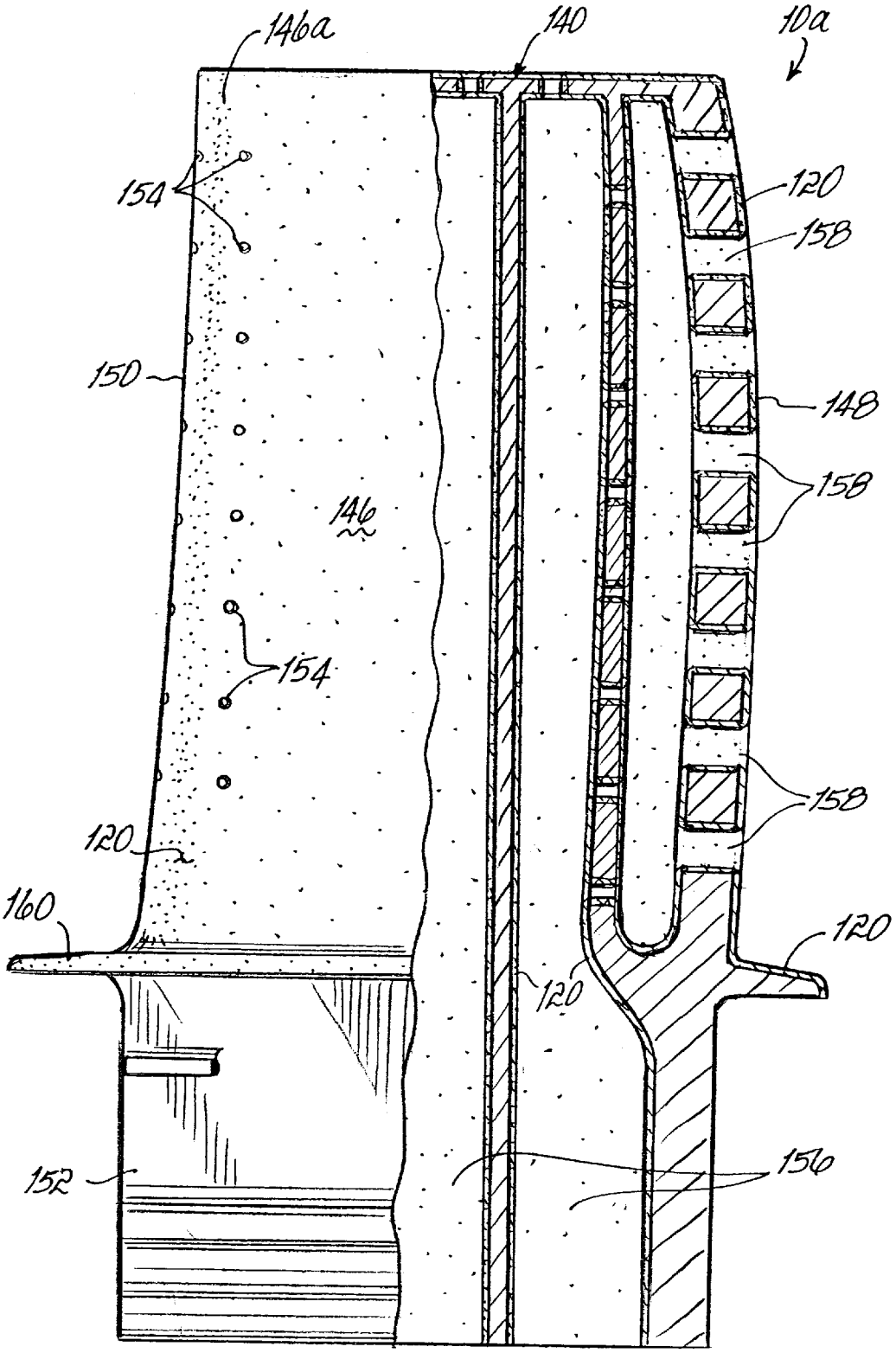
FIG. 6 is a side elevational view of the blade of FIG. 5 in partial cross-section along lines 6—6 thereof after being exposed to the deposition environment.

In accordance with the principles of the present invention, it is desirable to protect at least airflow surfaces 144, 146 and perhaps the upper surface 160 of root 152 all of which may be exposed to high-pressure, high heat airflow as at 142 (FIG. 5). Accordingly, inoculant 50 may be applied to surfaces 144, 146 and 160 such as by hand application with a paint brush B (FIG. 5) with inoculant 50 being applied in a liquid form and then dried as above-described. Alternatively, blade 10*a* may be inverted and dipped into a bath (not shown) of liquid-state inoculant 50 or may be sprayed with liquid-state inoculant 50 before drying and heating. If inoculant 50 is a metal-halogen Lewis acid, powder 135 may be sprayed thereon, also prior to drying and heating. Thereafter, pre-coated blade 10*a* (which may advantageously first be dried and heated) may be placed into the deposition environment 26 (FIG. 4) whereupon the intermetallic(s) layer 60, 70 or 100 will be formed on surfaces 144, 146 and 160 to the desired thickness (thick layer 120 of layer 100 being shown in FIG. 6). The remaining portions of root 152 which are to interfit with other components of the turbine disk (not shown) are advantageously either shielded so that no intermetallic layer forms thereon or are permitted to form a thinner intermetallic layer (e.g., layer 110) which may be removed by conventional means before blade 10*a* is placed into the turbine disk (not shown) for deployment in the engine (not shown).

Additionally, and advantageously, the interior channels 156 (FIG. 6) of blade component 10*a* may be protected. While previous efforts to provide an intermetallic layer on the interior channel 156 have generally been met with little success, in part due to the limited throw of the deposition environment, it is possible to provide inoculant coating 50 to the internal surfaces of channel 156 such as by dipping airfoil segment 140 into a bath (not shown) of liquid-state inoculant 50. The liquid inoculant will then migrate through cooling holes 154 and 158 into channels 156 to thereby provide a pre-coating onto the surfaces of channels 156 and the surfaces defining holes 154 and 158. Thereafter, the blade 10*a* may be dried such as in an oven to the desired temperature which will cause all of the liquid-state inoculant to form a pre-coating 50 on surfaces 144, 146, the surfaces defining cooling holes 154, 158, and channel surfaces 156. Thereafter, placement of the pre-coated blade 10*a* in the deposition environment 26 will cause the intermetallic layer (s) to grow on not only surfaces 144 and 146 but may also assist in causing some level of intermetallic layer to form on the surfaces of channels 156 and/or cooling holes 154, 158 to thereby provide protection in those areas as well.

Figure 7:
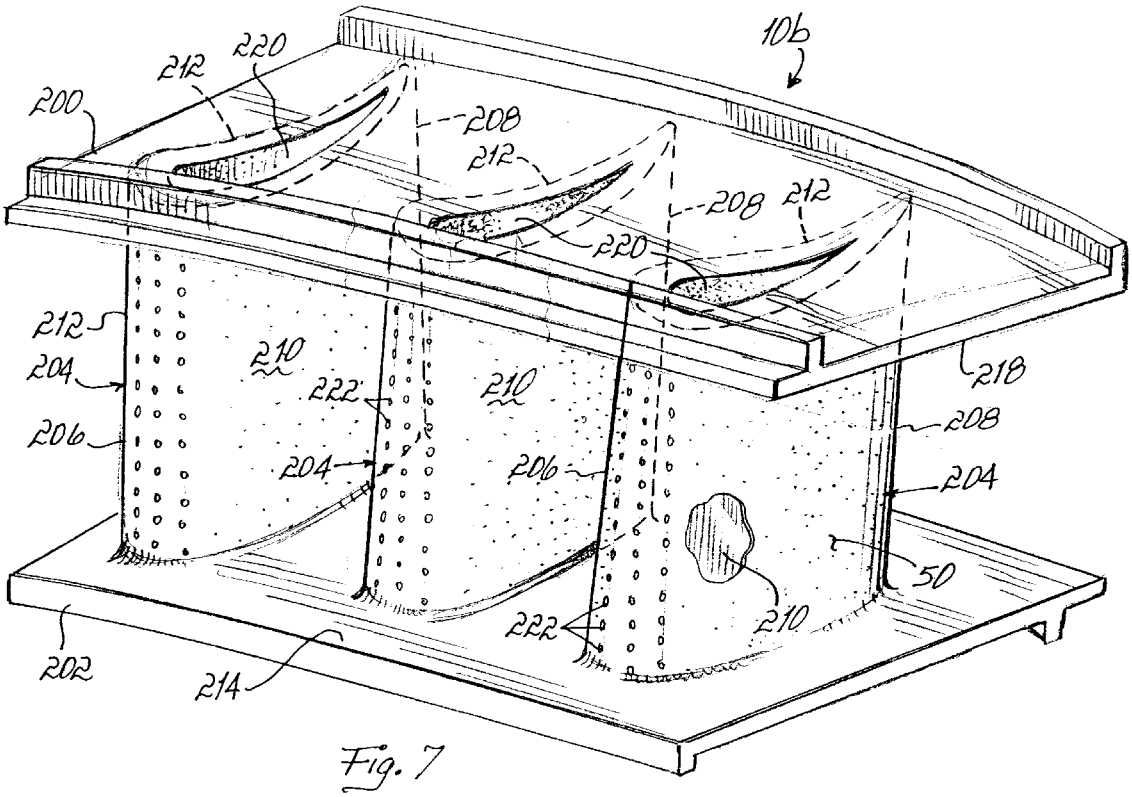
FIG. 7 is a perspective, partially cut-away view of a vane of a jet engine showing a selectively applied pre-coat in accordance with the principles of the present invention.

With reference to FIG. 7, a jet engine turbine vane component 10*b* is shown. Vane component 10*b* includes inner and outer arcuate bands 200, 202 which may be segments of a ring or may be continuous (the former shown in FIG. 7). Mounted between bands 200 and 202 are a plurality of spaced-apart vanes 204 with three vanes 204 being illustrated in the exemplary vane segment component 10*b* shown in FIG. 7. Each vane 204 has a suitable airfoil configuration defined between a leading edge 206 and a trailing edge 208. Each vane 204 thus defines between leading and trailing edges 206 and 208 vane surfaces 210, 212 which are to be protected in use. To this end, inoculant 50 (and powder 135, if desired) may be applied to surfaces 210 and 212 as well as exposed inwardly directed planar surfaces 214 and 218 of outer bands 200 and 202 and upon which the intermetallic layer(s) 60, 70 or 100 is to be formed in the deposition environment 26. Further, vanes 204 may also include hollow interiors 220 communicating through cooling holes 222 at leading and trailing edges 206 and 208, respectively (only cooling holes 222 at leading edge 206 are shown). Interior hollow segments 220 may have their surfaces coated by inoculant 50 by dipping vane segment component 10*b* into the liquid form of inoculant and then drying same in an oven prior to exposure of the component 10*b* to the deposition environment 26 (FIG. 4). In the deposition environment, intermetallic layers 60, 70 and/or 120 will form at the pre-coated surfaces.

Figure 8:
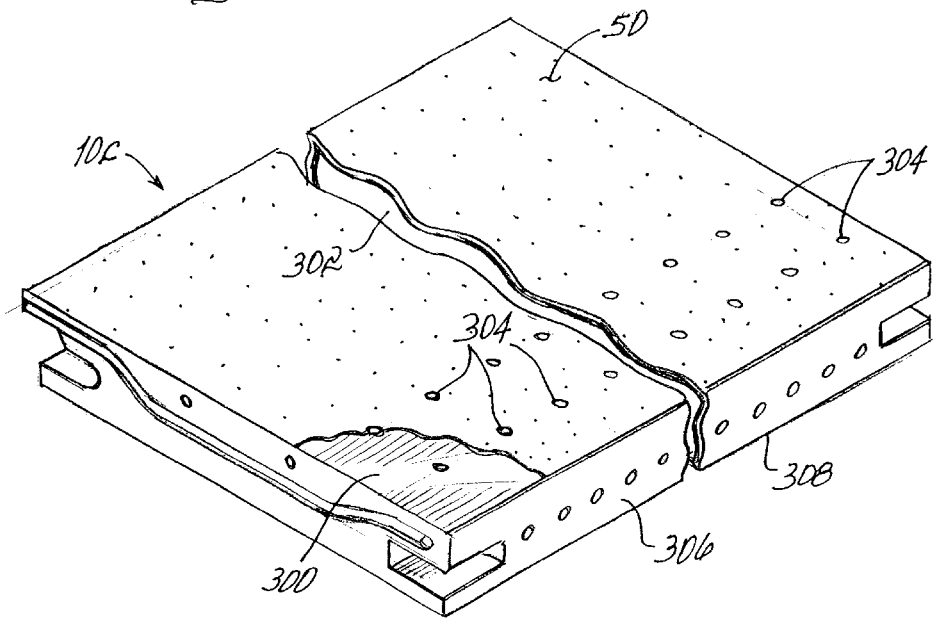
FIG. 8 is a perspective, partially cut-away view of a shroud of a jet engine showing a selectively applied pre-coat in accordance with the principles of the present invention.

Finally, and with reference to FIG. 8, a jet engine shroud component 10*c* is shown which has an upper surface 300 which communicates through a hollow interior 302 via cooling holes 304 in surface 300 and holes 306 in front edge 308. Surface 300 is to be protected such as by application of inoculant 50 (and powder 135, if desired) thereon for formation of the intermetallic layer at surface 300 in deposition environment 26 in accordance with the principles of the present invention. Further, shroud component 10*c* may be dipped in a liquid inoculant to form the pre-coating 50 on the surfaces of hollow interior 302, so as to facilitate formation of a protective intermetallic layer 60, 70 or 100 thereon as well.

In use, inoculant 50 is applied as a pre-coating to a surface 12, or surface portion 12*a*, of a metal component 10. Where metal component 10 is selected to be a jet engine aircraft component such as a blade 10*a*, vane segment 10*b*, or shroud 10*c*, the inoculant 50 is formed on one or more of the airflow surfaces and/or the surface(s) of a hollow interior. If desired, metal powder 135 may also be included with or applied to inoculant 50. The pre-coated component 10 is then placed in a deposition environment 26 for a desired time and an intermetallic layer 60, 70 or 120 is formed on the pre-coated surfaces as well as a lesser extent of intermetallic layer 110 on any unshielded and non pre-coated portions 12*b* of metal component 10. Where the inoculant 50 is either silane or a colloidal silica, silicon 130 may form in the intermetallic layer 60, 70 or 120. Similarly, if the inoculant 50 is a metal-halogen Lewis acid, the metal ion thereof may be platinum, chromium or zirconium, for example, which will cause platinum, chromium or zirconium 130 to form in the intermallic layer 60, 70 or 120.

By virtue of the foregoing, there is thus provided an improved deposition process by which to form an intermetallic layer on metal components.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, yttrium chunks (not shown) may be added to the deposition environment 26 to provide a shiny part, especially where inoculant 50 is a colloidal silica. Also, while certain jet engine components are shown in the presentation of the process of the present invention, the present invention may be beneficially applied to other aerospace, and indeed any other, metal components. Further, while the present invention has been explained in connection with the deposition environment 26 of a simple CVD furnace, it will be appreciated that the invention is equally applicable to the deposition environment created in any CVD furnace, including dynamic CVD processes in which the surface is exposed to the donor metal in the form of a gas carried into the deposition environment, either in a vacuum or partial pressure, and/or also in above-the-pack or in-the-pack coating processes. Thus, the term deposition environment will be understood to refer to any of the foregoing and not just to the environment created in the simple CVD furnace. The invention in its broader aspects is, therefore, not limited to the specific details, representative apparatus and method, and illustrative example shown and described. Accordingly, departures may be made from such details without departing from the spirit or scope of the general inventive concept.

Having described the invention, what is claimed is:

1. A deposition process comprising:

applying an inoculant to at least a portion of a surface of a metal component;

placing the metal component with the inoculant thereon in a chamber having a source of donor material independent of the component and any coating thereon; and while the metal component is in the chamber, exposing at least the inoculated surface portion and the independent source of donor material to a deposition environment in the chamber for a time to form an intermetallic layer at the inoculated surface portion including metal from the donor material therein, whereby the intermetallic layer forms at the inoculated surface portion to a thickness greater than would have been formed had the surface portion been exposed to the donor material in the deposition environment for said time without the inoculant having been first applied thereto.

2. A deposition process comprising:

placing a liquid silane onto at least a portion of a surface of a metal component and drying the liquid silane to a hard pre-coating;

placing the metal component with the hard pre-coating thereon in a deposition environment; and while the metal component is in the deposition environment, exposing at least the surface portion with the hard pre-coating thereon to a donor material for a time to form an intermetallic layer thereat including metal from the donor material therein.

3. A deposition process comprising:

applying an aluminum-free inoculant to at least a portion of a surface of a metal component;

placing the metal component with the aluminum-free inoculant thereon in a chamber having a source of aluminum donor material independent of the component and any coating thereon; and while the metal component is in the chamber, exposing at least the inoculated surface portion and the independent source of aluminum donor material to a deposition environment in the chamber for a time to form an intermetallic layer at the inoculated surface portion including metal from the aluminum donor material therein.

4. The deposition process of claim 3, further comprising applying the inoculant as a liquid and drying the inoculant before placing the metal component in the deposition environment.

5. A deposition process comprising:

placing onto at least a surface portion of a metal component a metal-halogen Lewis acid having a metal ion desired to be incorporated into an intermetallic layer to be formed on the metal component;

placing the metal component with the Lewis Acid thereon in a deposition environment; and while the metal component is in the deposition environment, exposing at least the surface portion with the Lewis Acid thereon to a donor material for a time to form an intermetallic layer thereat including metal from the donor material therein.

6. The deposition process of claim 5, further comprising selecting a Lewis acid including a platinum ion.

7. The deposition process of claim 5, further comprising selecting a Lewis acid including a chromium ion.

8. A The deposition process of claim 5, further comprising selecting a Lewis acid including a zirconium ion.

9. The deposition process of claim 1, further comprising selecting a colloidal silica as the inoculant, wherein applying an inoculant includes placing the colloidal silica onto the surface portion.

10. The deposition process of claim 1, wherein the inoculant is applied to a selected portion of the surface.

11. The deposition process of claim 1, wherein the inoculant is applied to the entire surface.

12. The deposition process of claim 1, further comprising applying the inoculant in multiple layers.

13. The deposition process of claim 1, further comprising first providing the metal component from a group consisting of jet engine components.

14. The deposition process of claim 1, further comprising first providing the metal component having metal comprised of a nickel-based superalloy.

15. The deposition process of claim 1, further comprising first providing the metal component having metal comprised of a cobalt-based superalloy.

16. A deposition process comprising:

applying a metal-halogen Lewis acid to at least a portion of a surface of a metal component;

placing the metal component with the Lewis acid thereon in a deposition environment including a donor material separate from the Lewis acid; and while the metal component is in the deposition environment, exposing at least the surface portion of the Lewis acid thereon to the separate donor material for a time to form an intermetallic layer at the surface portion including metal from the separate donor material therein.

17. The deposition process of claim 16, further comprising first providing the metal component from a group consisting of jet engine components.

18. The deposition process of claim 16, further comprising first providing the metal component having metal comprised of a nickel-based superalloy.

19. The deposition process of claim 16, further comprising first providing the metal component having metal comprised of a cobalt-based superalloy.

20. The deposition process of claim 19, further comprising including a metal powder with the Lewis acid before placing the metal component in the deposition environment.

21. A deposition process comprising:

applying a silane material to at least a portion of a surface of a metal component;

placing the metal component with the silane material thereon in a deposition environment; and while the metal component is in the deposition environment, exposing at least the surface portion with the silane material thereon to a donor material for a time to form an intermetallic layer at the surface portion including at least metal from the donor material therein.

22. The deposition process of claim 21, further comprising first providing the metal component from a group consisting of jet engine components.

23. The deposition process of claim 21, further comprising first providing the metal component having metal comprised of a nickel-based superalloy.

24. The deposition environment of claim 21, further comprising first providing the metal component having metal comprised of a cobalt-based superalloy.

25. A deposition process comprising:

applying a colloidal silica to at least a portion of a surface of a metal component;

placing the metal component with the colloidal silica thereon in a chamber having a source of donor material independent of the component and any coating thereon; and while the metal component is in the chamber, exposing at least the surface portion with the colloidal silica thereon and the independent source of donor material to a deposition environment in the chamber for a time to form an intermetallic layer at the surface portion including metal from at least the separate donor material therein.

26. The deposition process of claim 25, further comprising first providing the metal component from a group consisting of jet engine components.

27. The deposition process of claim 25, further comprising first providing the metal component having metal comprised of a nickel-based superalloy.

28. The deposition process of claim 25, comprising first providing the metal component having metal comprised of a cobalt-based superalloy.

29. deposition process for a jet engine component comprising:

selecting a jet engine component having a metal surface;

pre-coating at least a portion of the metal surface with an inoculant; placing the jet engine component in a chamber having a source of donor material independent of the component and any coating thereon; and exposing at least the pre-coated surface portion and the independent source of donor material to a deposition environment in the chamber for a period of time to form an intermetallic layer at the pre-coated surface portion including metal from the donor material therein.

30. A deposition process for a jet engine component comprising:

selecting a jet engine component having a metal surface;

pre-coating at least a portion of the metal surface with a silane material; and forming an intermetallic layer at the pre-coated surface portion.

31. The deposition process of claim 29, further comprising selecting the inoculant as a colloidal silica.

32. A deposition process for a jet engine component comprising:

selecting a let engine component having a metal surface;

pre-coating at least a portion of the metal surface with a metal-halogen Lewis acid; and exposing at least the pre-coated surface portion to a deposition environment including a separate donor material for a period of time for form an intermetallic layer at the pre-coated surface portion.

33. The deposition process of claim 32, further comprising including a metal powder with the metal-halogen Lewis acid before forming the intermetallic layer.

34. A deposition process for forming a multi-component intermetallic layer on a jet engine component comprising:

selecting a jet engine component having a metal surface;

selecting a metal-halogen Lewis acid having a desired functional material for inclusion in said intermetallic layer;

applying the selected Lewis acid to at least a portion of the component metal surface; and exposing at least the surface portion with the Lewis acid thereon to a deposition environment including a separate donor material for a period of time to form a multi-component intermetallic layer including metal from the donor material at the surface portion while causing the desired functional material from the Lewis acid to disperse into the intermetallic layer.

35. The deposition process of claim 34, wherein the desired functional material is selected from the group consisting of platinum, chromium, silicon, and zirconium.

36. The deposition process of claim 16, further comprising selecting the Lewis acid in a liquid form, applying the liquid form of Lewis acid to the surface portion, and drying the liquid Lewis acid to a hard pre-coating.

37. The deposition process of claim 36, further comprising including a metal powder with the Lewis acid.

38. A deposition process comprising:

applying a coating consisting essentially of silane directly to a surface of a metal component;

placing a donor material separate from the coated part in a deposition chamber; and without applying further material to the coated surface, placing at least the coated surface of the metal component in the deposition chamber spaced from the donor material.

39. The deposition process of claim 38, further comprising creating a deposition environment in the deposition chamber with the donor material and at least the coated surface of the metal component being exposed to the deposition environment.

40. A deposition process comprising:

applying a coating consisting essentially of a Lewis Acid directly to a surface of a metal component;

placing a donor material separate from the coated part in a deposition chamber; and without applying further material to the coated surface, placing at least the coated surface of the metal component in the deposition chamber spaced from the donor material.

41. The deposition process of claim 40, further comprising creating a deposition environment in the deposition chamber with the donor material and at least the coated surface of the metal component being exposed to the deposition environment.

* * * * *

UNITED STATES PATENT AND TRADEMARK OFFICE

CERTIFICATE OF CORRECTION

PATENT NO. : 6,605,161 B1
DATED : August 12, 2003
INVENTOR(S) : David C. Fairbourn It is certified that error appears in the above-identified patent and that said Letters Patent is hereby corrected as shown below:

Column 2,
Line 60, “by way of example,” should read -- by the way example. --

Column 7,
Line 21, “Bis(trimethoxysilyl Ethane” should read -- Bis(trimethoxysilyl)Ethane --

Figure 2C:
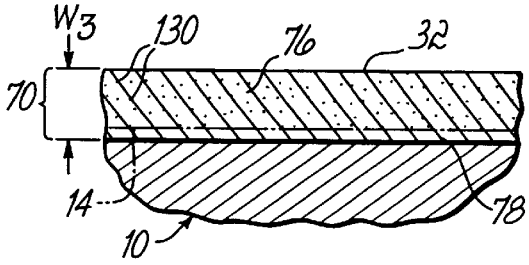
Figure 2D:
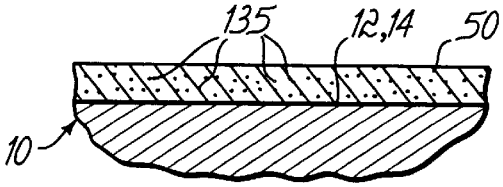
FIG. 2D is a greatly enlarged view of a portion of the component of FIG. 1A with a metal powder enhancement to the inoculant to reduce grain boundary problems.

Column 8,
Line 36, “in FIG. 2B, 2C and 3B,” should read -- in FIGS. 2B, 2C and 3B, --

Column 10,
Lines 8-9, “layer (s) to grow” should read -- layer(s) to grow” --

Column 12,
Lines 8, 24, 26, 28, 30, 34 and 36, delete “,”
Lines 17 and 21, “Lewis Acid” should read -- Lewis acid --
Lines 38, 40, 43, 46, 61, 64, 67 and 70, delete “,”
Lines 56-57, “portion of the Lewis acid” should read -- portion with the Lewis acid --

Column 13,
Lines 12, 15, 18, 35, 38 and 63, delete “,”
Line 33, delete “separate”
Line 41, “claim 25, comprising” should read -- claim 25 further comprising --
Line 44, “deposition process” should read -- A deposition process --
Line 48, the text starting “placing …” should be indented as its own paragraph Column 14,
Line 3, “a let engine” should read -- a jet engine --
Line 8, “for form” should read -- to form --
Lines 10, 28, 31, 35, 46 and 60, delete “,”

UNITED STATES PATENT AND TRADEMARK OFFICE

CERTIFICATE OF CORRECTION

PATENT NO. : 6,605,161 B1
DATED : August 12, 2003
INVENTOR(S) : David C. Fairbourn It is certified that error appears in the above-identified patent and that said Letters Patent is hereby corrected as shown below:

Column 14 (cont'd),
Line 52, "Lewis Acid" should read -- Lewis acid --

Signed and Sealed this

Thirteenth Day of January, 2004

JON W. DUDAS
*Acting Director of the United States Patent and Trademark Office*